United States Patent [19]

Douglas et al.

[11] 4,373,289

[45] Feb. 15, 1983

[54] TOY TRAP DOOR MECHANISM

[75] Inventors: Raymond J. Douglas, San Pedro; Herbert May, Torrance; Jeffrey B. Poznick, La Crescenta; Roger H. Sweet, Long Beach, all of Calif.

[73] Assignee: Mattel, Inc., Hawthorne, Calif.

[21] Appl. No.: 332,642

[22] Filed: Dec. 21, 1981

[51] Int. Cl.[3] ..... A63H 33/00

[52] U.S. Cl. ..... 46/1 R; 46/12; 292/200; 272/25

[58] Field of Search ..... 46/1 R, 12, 13, 116, 46/2; 272/21, 25, 11, 8 R, 8 N; 292/202, 204, 228, 219, 200, 226, 194, 46, 272

[56] References Cited

U.S. PATENT DOCUMENTS 873,315 12/1907 Lafayette ..... 272/25

3,899,906 8/1975 Bradstock ..... 292/200 X

*Primary Examiner*—Mickey Yu

*Attorney, Agent, or Firm*—Reagin & King

[57] ABSTRACT

A toy trap door mechanism is disclosed which includes a trap door pivotably mounted within and flush to a panel which simulates the floor of a castle. A chair in the shape of a throne is rotatably mounted to the floor in the vicinity of the trap door. An actuating lever is pivotably mounted to the underside of the floor and is operatively coupled to both the chair and the trap door. When the chair is rotated from a first position facing an observer to a second position facing the trap door, the lever unlatches the trap door which swings open. Holding the trap door in the closed position and rotating the chair to the first position resets the mechanism.

6 Claims, 14 Drawing Figures

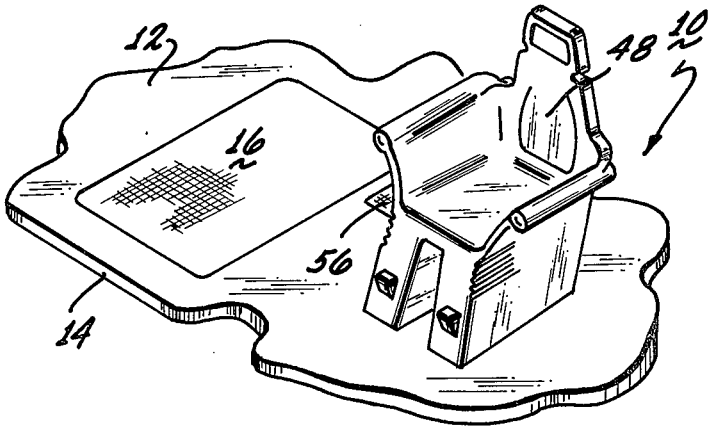
Fig. 1
Fig. 2
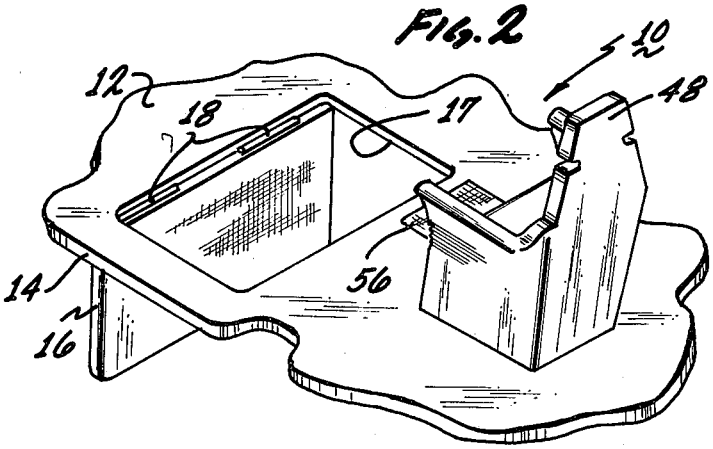
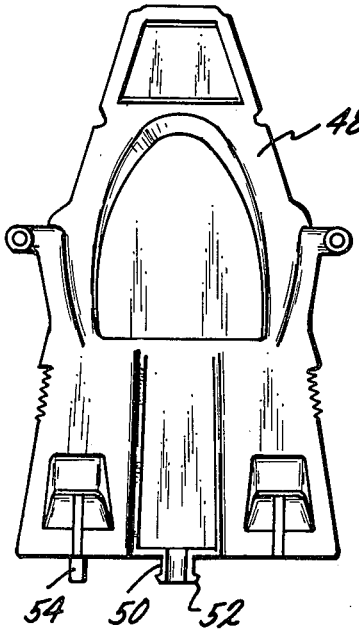
Fig. 11
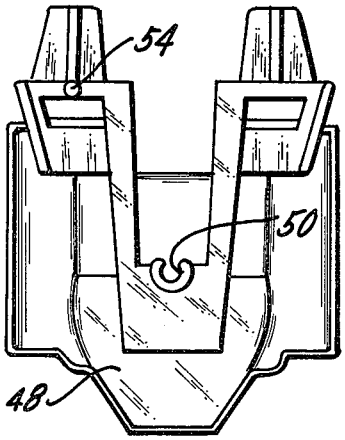
Fig. 12

TOY TRAP DOOR MECHANISM

BACKGROUND OF THE INVENTION

This invention relates to toys and, more particularly, to a trap door mechanism for use in toys.

Over the years, a variety of toys have been designed which recreate popular adventure scenes in miniature. Such scenes are typically adapted from popular novels and motion pictures. The most exciting of these adventure scenes include some element of suspense or surprise. For example, secret compartments and trap doors have been employed in adventure stories to provide an element of surprise.

Due to the complexities of designing and constructing devices such as secret compartments and trap doors, many toys which portray adventure scenes do not include these devices. Consequently, such toys are lacking in excitement; and children become bored with their use in a short period of time.

Those toys which do employ devices such as trap doors usually do so in a manner which negates the element of surprise. For example, U.S. Pat. No. 2,373,367, issued Apr. 10, 1945, to C. E. Wilson and U.S. Pat. No. 765,170, issued July 19, 1904, to J. J. Duffie each shows the use of a trap door in a device designed to simulate a gallows. The element of surprise is lacking in these devices in part because both the trap door and the mechanism for operating it are in plain view of the observer.

It is, consequently, an object of this invention to provide a new and improved toy trap door mechanism.

It is another object of this invention to provide a toy trap door mechanism the operation of which provides a strong element of surprise to the observer.

It is another object of this invention to provide a toy trap door mechanism which is inexpensive to manufacture.

SUMMARY OF THE INVENTION

The foregoing and other objects of the invention are accomplished by a trap door mechanism included as part of a toy which simulates an adventure scene. The toy includes a panel which may simulate the floor of a castle. A trap door is pivotally mounted within, and flush to, the floor in a manner which disguises the existence of the door to an observer.

A chair which may be in the form of a throne is rotatably mounted to the floor in the vicinity of the trap door. An actuating lever is also provided which is pivotably mounted to the underside of the floor and is hidden from the view of the observer. The lever acts as a latch to maintain the trap door in a closed position flush with the floor. The lever is operatively coupled to the chair beneath the floor so that when the chair is rotated from a first position facing the observer to a second position facing the trap door, the lever unlatches the trap door which then swings open. Holding the trap door in the closed position and rotating the chair to the first position resets the mechanism.

BRIEF DESCRIPTION OF THE DRAWINGS

FIG. 1 is a perspective view of the trap door mechanism of the present invention showing the trap door and a chair used to actuate the trap door and illustrating the relative positions of each when the trap door is in the closed position;

FIG. 2 is a perspective view of the mechanism of FIG. 1 showing the relative positions of the trap door and the chair when the trap door is in the open position;

FIG. 11 is a front view of a chair used in the construction of the trap door mechanism of the present invention;

FIG. 12 is a bottom view of the chair of FIG. 11;

DESCRIPTION OF THE PREFERRED EMBODIMENT

Figure 13:
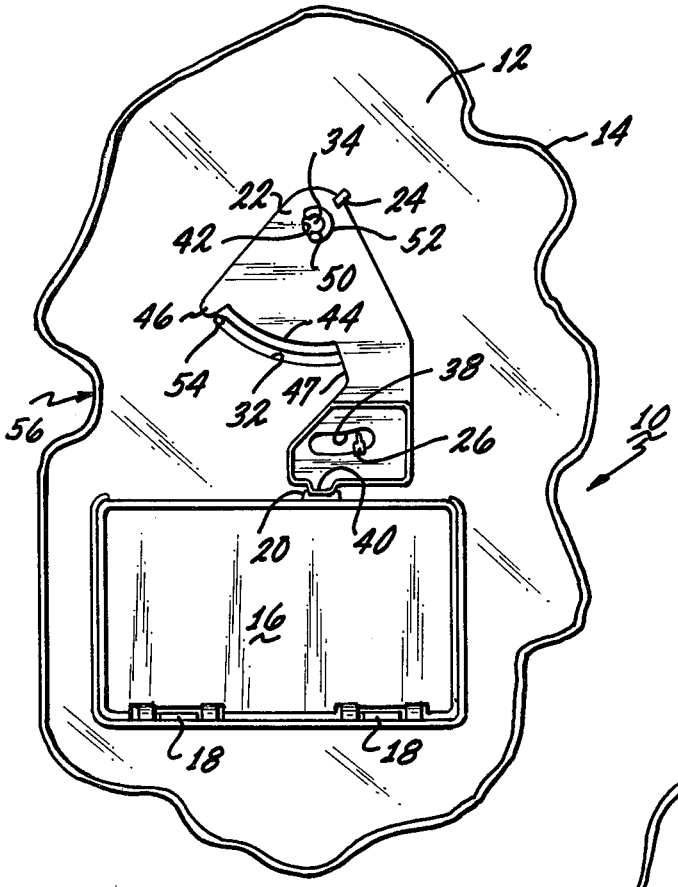
FIG. 13 is a bottom view of the trap door mechanism of FIG. 1 showing the relative positions of the various elements when the trap door is latched closed.

Referring now to the drawings and, more particularly, to FIGS. 1 and 13, there are shown, respectively, a perspective view of a trap door mechanism 10 constructed in accordance with the present invention and a bottom view of the mechanism 10. These Figures illustrate the relative positions of the various elements when the trap door is latched closed. The mechanism 10 includes a floor 12 which may simulate, for example, the floor of a castle, and which is in the form of a flat panel having a depending skirt 14 around the periphery thereof. The skirt 14 acts to provide rigidity for the floor 12 as well as to hide from view portions of the mechanism 10 mounted to the underside of the floor 12 in the manner described below. The floor 12 is typically formed of a moldable plastic such as high impact Styrene.

Figure 3:
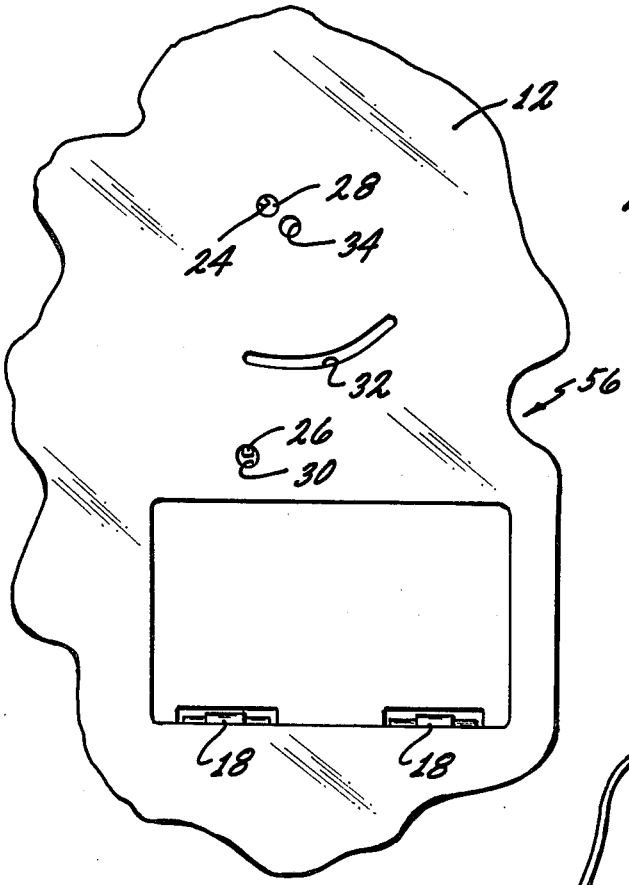
FIG. 3 is a top view of a floor used in the construction of the trap door mechanism of the present invention.
Figure 4:
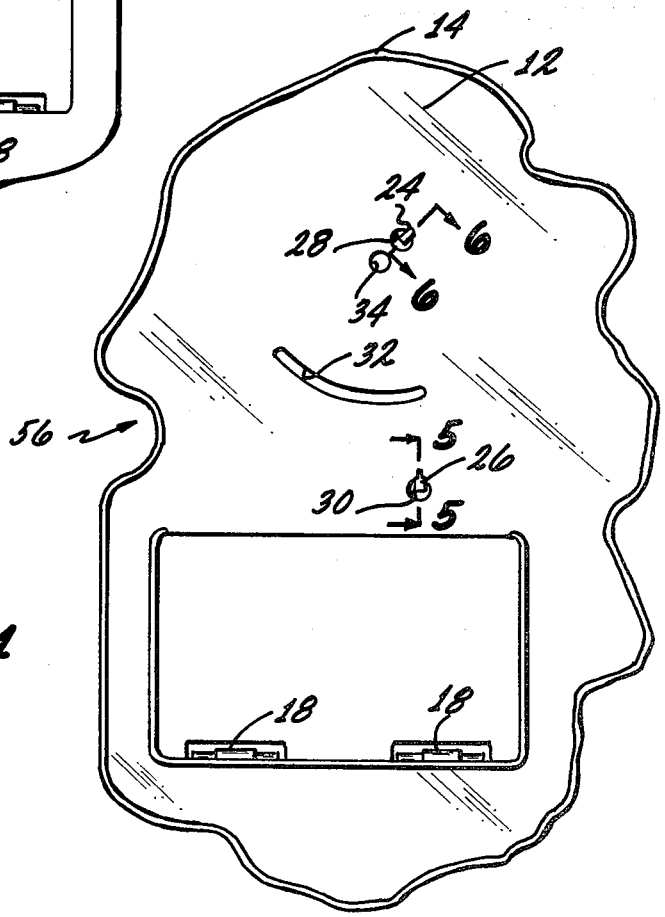
FIG. 4 is a bottom view of the floor of FIG. 3.
Figure 5:
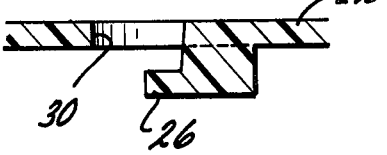
FIG. 5 is a cross-sectional view of a portion of the floor, taken along the line 5—5 of FIG. 4.
Figure 6:
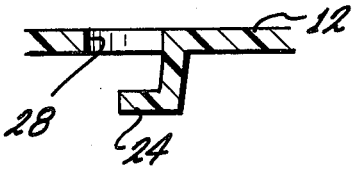
FIG. 6 is a cross-sectional view of another portion of the floor, taken along the line 6—6 of FIG. 4.

As shown in FIG. 4, which is a bottom view of the floor 12, hook-shaped projections 24 and 26 are provided on the bottom surface of the floor 12. The form of the hook-shaped projections 24 and 26 is more clearly shown in FIGS. 5 and 6. Holes 28 and 30, shown in FIGS. 3 and 4, are provided adjacent, respectively, the projections 24 and 26 and are used to aid in the formation of the projections 24 and 26 during the molding of the floor 12 in a manner well known to those skilled in the art. The floor 12 also includes an arcuate shaped slot 32 and a hole 34 adjacent the projection 24.

Figure 7:
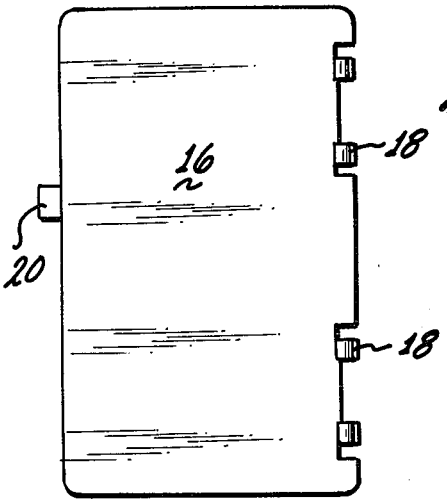
FIG. 7 is a bottom view of the trap door used in the construction of the present invention.
Figure 8:
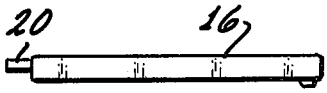
FIG. 8 is an end view of the trap door of FIG. 7.

FIG. 13 shows a trap door 16 which is pivotably mounted within the floor 12 using hinges 18. When opened, the door 16 swings downward exposing an opening 17 in the floor 12 as shown in FIG. 2. The hinges 18 may be of the snap-together type well known to those skilled in the art. As shown in FIGS. 7 and 8, the door 16 is in the form of a flat plate and includes a tab 20 which projects from the side opposite the hinges 18. An actuating lever 22 is also provided which is supported underneath the floor 12 using the hook-shaped projections 24 and 26 in the manner described below.

Figure 10:
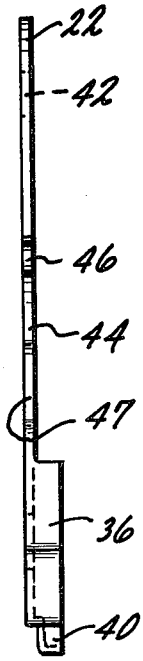
FIG. 10 is an end view of the actuating lever of FIG. 9.
Figure 9:
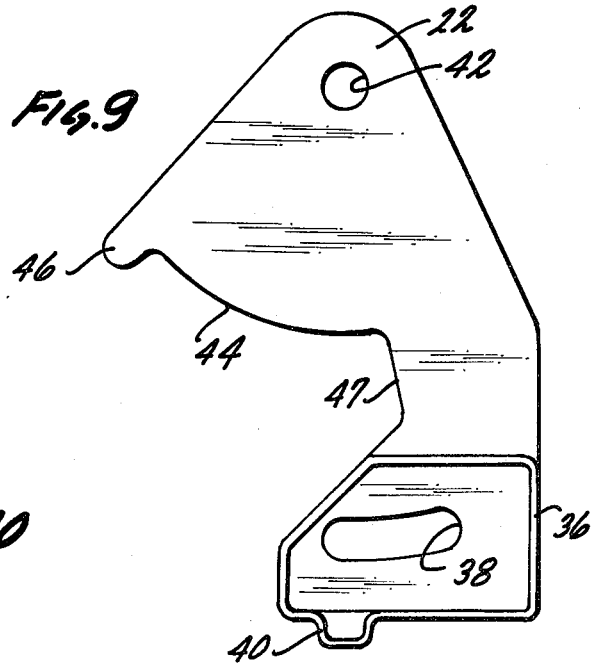
FIG. 9 is a bottom view of an activating lever used in the construction of the trap door mechanism of the present invention.

The actuating lever 22, shown in detail in FIGS. 9 and 10, is in the form of a thin plate which is reinforced at one end by a wall 36. An arcuate shaped slot 38 is provided within the walled section, and a hole 42 is provided at the upper end of the lever 22 as shown in FIG. 9. The lever 22 has an arcuate-shaped section 44 which terminates at one end in a projecting tab 46 and which terminates at the other end in a section 47 which is generally perpendicular to the section 44. A tab 40 is also provided which projects from the lower end of the lever 22.

As shown in FIG. 13, the lever 22 is held to the underside of the floor 12 in the following manner. The lever 22 is positioned so that the hook-shaped projection 26 on the floor 12 projects through the slot 38 in the lever 22 and extends over a portion of the surface of the lever 22 to retain the lower end thereof. In similar fashion, the hook-shaped projection 24 on the floor 12 extends over a portion of the surface of the lever 22 to retain the upper end thereof. Sufficient clearance is provided between the projections 24 and 26 and the surface of the floor 12 to permit the lever 22 to rotate, as described below, with respect to the floor 12. It should also be noted that the lever 22 is positioned so that the hole 42 in the lever 22 is aligned with the hole 34 in the floor 12.

In FIG. 1, it can be seen that the trap door mechanism 10 of the present invention also includes an object in the form of a throne or chair 48. The chair 48 is rotatably mounted to the floor 12 in the following manner. FIGS. 11 and 12 are, respectively, front and bottom views of the chair 48 which may be formed of a moldable plastic material such as high impact Styrene. As shown in these Figures, the chair 48 includes a generally U-shaped projection 50 which depends from the bottom of the chair 48 at a point adjacent the center thereof. The lower end of the projection 50 is provided with a flange 52. The chair 48 also includes a pin 54 which depends from the bottom of the chair 48 at a point adjacent one corner thereof.

As is best seen in FIG. 13, the chair 48 is mounted to the floor 12 by aligning the pin 54 of the chair 48 within the slot 32 of the floor 12 and by inserting the U-shaped projection 50 of the chair 48 through both the hole 34 in the floor 12 and the hole 42 in the lever 22. The flange 52 provides a snap-fit with the lever 22 and acts to retain the chair 48 to the floor 12. Mounted in this manner, the chair 48 is free to rotate about the projection 50 in a plane parallel to the plane of the floor 12, the rotation being limited by the travel of the pin 54 within the arcuate shaped slot 32. The length of the pin 54 is sufficient to both pass through the slot 32 and to engage portions of the lever 22 in the manner described below.

The operation of the trap door mechanism 10 is as follows. Facing toward the front side 56 of the floor 12, with the chair 48 in the position shown in FIG. 1 facing toward the front side 56 of the floor 12, the pin 54 projecting therefrom is located adjacent the left end of the arcuate shaped slot 32 in the floor 12 (see FIG. 13). In this location, the pin 54 presses against one side of the tab 46 of the lever 22 causing it to rotate to the position shown in FIG. 13. In this orientation, the tab 40 of the lever 22 is positioned over the tab 20 of the trap door 16 and serves to hold the door 16 parallel with the floor 12. Accordingly, if the trap door 16 is held in the closed position (parallel with the floor 12) and the chair 48 is rotated to the position shown in FIG. 1, the door 16 will be latched in the closed position by the alignment of the tabs 40 and 20 as shown in FIG. 13.

Figure 14:
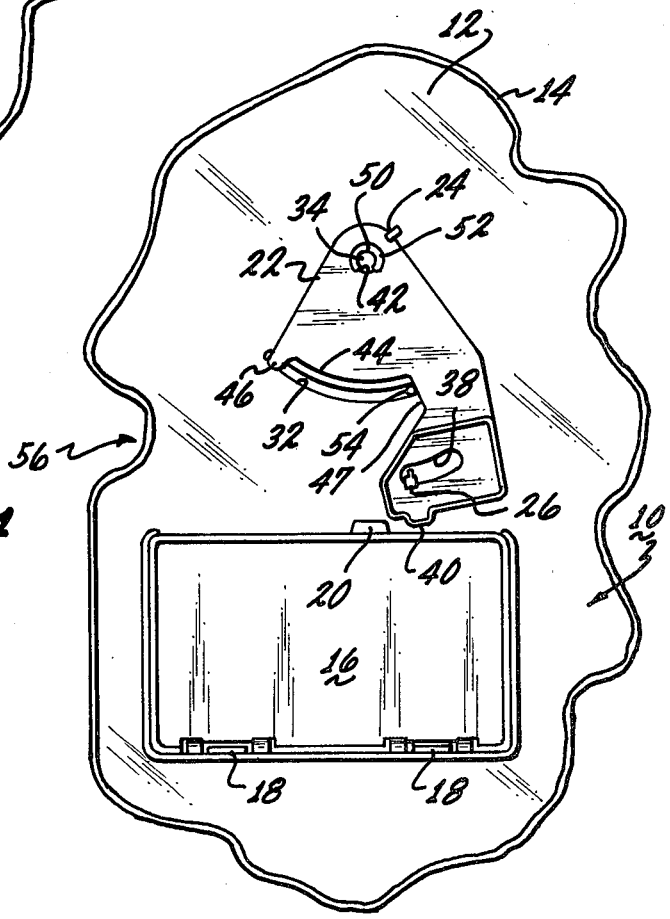
FIG. 14 is a bottom view of the trap door mechanism of FIG. 2 showing the relative positions of the various elements when the trap door is unlatched.

The trap door 16 is caused to open when the chair 48 is rotated approximately sixty-five degrees so that it is facing the door 16 as shown in FIG. 2. This rotation of the chair 48 rotates the pin 54 to the right end of the slot 32 in the floor 12 as shown in FIG. 14. As the pin 54 approaches the right end of the slot 32, it engages the section 47 of the lever 22 causing it to rotate to the position shown in FIG. 14. In this position, the tab 40 of the lever 22 is moved clear of the tab 20 of the door 16 so that the trap door 16 may swing open as shown in FIG. 2. The mechanism 10 is reset by holding the door 16 in the closed position and by rotating the chair 48 back to the position shown in FIG. 1. This causes the lever 22 to reassume the position shown in FIG. 13 and latch the door 16 in the closed position.

The trap door mechanism 10 of the present invention provides a great element of surprise. This is due in part to the lack of association by an observer of the rotation of the chair 48 with the operation of the door 16. In addition, the operating mechanism is hidden from view under the floor 12 with the aid of the skirt 14. The trap door 16, which in the closed position sits flush with the floor 12, may be further disguised (for example as a rug) by use of suitable decals. The hole 28 in the floor 12 adjacent the projection 24 is hidden from view by the chair 48. The hole 30 in the floor 12 adjacent the projection 26 may also be hidden from view by use of a suitably placed decal 56 such as that shown in FIGS. 1 and 2. In this manner, any evidence of the existence of a door operating mechanism is totally hidden from view of the observer.

The element of surprise is further heightened by the mechanism 10 of the present invention because the action of releasing the trap door 16 does not take place until the chair 48 is rotated almost ninety degrees from the starting position shown in FIG. 1. This results because, as shown in FIGS. 13 and 14, the lever 22 is shaped so that the pin 54 does not engage the lever 22 until the chair 48 has rotated close to the position shown in FIG. 2.

The toy trap door mechanism 10 of the present invention may be easily incorporated into a variety of toys and games where it is desired to provide an element of suspense or surprise. For example, miniature toy figures may be employed, one of which (a hero) sits on the throne or chair 48, and the other of which (a villain) stands on the trap door 16. When the hero turns in his chair 48, the villain is dropped through the trap door 16.

The trap door mechanism 10 of the present invention is also very inexpensive to manufacture, requiring only four parts, the floor 12, the door 16, the lever 22 and the chair 48. All of these parts either slide or snap together providing for inexpensive assembly.

While the invention is disclosed and a particular embodiment is described in detail, it is not intended that the invention be limited solely to this embodiment. Many modifications will occur to those skilled in the art which are within the spirit and scope of the invention. It is thus intended that the invention be limited in scope only by the appended claims.

What is claimed is:

1. A toy trap door mechanism, comprising:

a trap door;

a generally flat panel designed to support the trap door;

means for pivotably mounting the trap door within the panel so that the trap door may swing from a latched position parallel with the panel to an unlatched position below the panel;

an object designed to be rotatably mounted to the upper surface of the panel;

means for rotatably mounting the object to the panel including a pin depending from the object and extending through an opening in the panel so that the object can be rotated about the pin in a plane parallel to the plane of the panel; and means mounted underneath the panel for operatively connecting the object to the trap door to both latch and unlatch the trap door, whereby when the object is rotated to a first object position the trap door is latched in the closed position, and when the object is rotated to a second object position, the trap door is unlatched, and where the means for operatively connecting the object to the trap door includes an actuating lever;

means for supporting the lever underneath the panel between the object and the trap door including pivotably attaching the lever to the pin so that the lever may pivot freely about the pin in a manner which permits the object to rotate without causing the lever to pivot;

means for pivoting the lever to a first lever position where a first portion of the lever overlaps a portion of the trap door to latch the door closed; and means for pivoting the lever to a second lever position were the first portion of the lever does not overlap the portion of the trap door, so that the door may swing to the unlatched position.

2. The mechanism of claim 1 in which the means for pivoting the lever to a first lever position includes a projection depending from the object and extending through an aperture in the panel to contact a second portion of the lever and to pivot the lever to the first lever position whenever the object is rotated to the first object position.

3. The mechanism of claim 2 in which the means for pivoting the lever to a second lever position includes the projection depending from the object and extending through the aperture in the panel to contact a third portion of the lever and to pivot the lever to the second lever position whenever the object is rotated to the second object position.

4. The mechanism of claim 1 in which the object is formed in the shape of a chair.

5. The mechanism of claim 1 in which the second object position is oriented at approximately sixty-five degrees with respect to the first object position.

6. A trap door mechanism, comprising:

a generally flat panel having an upper surface and a lower surface, the panel having an opening, an arcuate slot and an aperture provided therein;

a trap door pivotably mounted at one end to the panel in the opening, the trap door forming a continuation of the panel when the trap door is closed and exposing the opening when the trap door is opened;

a first hook-shaped projection depending from the lower surface of the panel adjacent the aperture;

a second hook-shaped projection depending from the lower surface of the panel intermediate the arcuate slot and the opening;

a generally flat lever having an aperture provided adjacent one end of the lever and an arcuate slot provided adjacent the other end of the lever, having a generally centrally located arcuate segment from which extends a first projecting surface at one end of the segment and a second projecting surface at the other end of the segment, and having a tab which projects from the other end of the lever, the lever being positioned adjacent the lower surface of the panel so that the second hook-shaped projection extends through the arcuate slot in the lever to retain the other end of the lever, so that the first hook-shaped projection extends over the one end of the lever to retain that one end, and so that the aperture in the lever is aligned with the aperture in the panel;

a tab which projects from the free end of the trap door and which lies adjacent the lower surface of the panel when the trap door is closed; and a chair having a first projection depending therefrom for pivotably coupling the chair to the panel through both the aperture in the panel and the aperture in the lever, and having a second projection depending therefrom which extends through the arcuate slot in the panel to selectively engage the first and second projecting surfaces of the lever as the chair is pivoted to a first position and to a second position, respectively, the engagement with the first projecting surface of the lever causing the lever to pivot to a first lever position in which the tab on the lever aligns with the tab on the door in the closed position in a manner which prevents the door from opening, and the engagement with the second projecting surface of the lever causing the lever to pivot to a second lever position in which the tab on the lever is moved clear of the tab on the door, whereby the door is free to swing open.

* * * * *